US005099135A

United States Patent [19]

Gemmill

[11] Patent Number: 5,099,135

[45] Date of Patent: Mar. 24, 1992

[54] X-RAY HAND SHIELD

[75] Inventor: Roderique S. Gemmill, Davie, Fla.

[73] Assignee: Radiation Concepts, Inc, Fort Lauderdale, Fla.

[21] Appl. No.: 562,331

[22] Filed: Aug. 3, 1990

[51] Int. Cl.[5] ..... G21F 3/02

[52] U.S. Cl. ..... 250/516.1; 250/519.1

[58] Field of Search ..... 250/515.1, 516.1, 519.1; 2/16, 19

[56] References Cited

U.S. PATENT DOCUMENTS

| | | | |
|---|---|---|---|
| 458,888 | 9/1891 | Eisele | 2/19 |
| 1,562,176 | 11/1925 | Latina | 2/19 |
| 2,286,877 | 6/1942 | Sternlicht | 250/516.1 |
| 2,328,105 | 8/1943 | Strobino | 2/16 |
| 3,239,669 | 3/1966 | Weinberger | 250/519.1 |
| 4,665,561 | 5/1987 | Aoki | 2/19 |
| 4,937,882 | 7/1990 | Hayes | 2/19 |

*Primary Examiner*—Bruce C. Anderson

*Attorney, Agent, or Firm*—Richard M. Saccocio

[57] ABSTRACT

X-ray radiation shielding apparatus for a person's hands is disclosed. The shielding apparatus comprises layers of flexible shielding material such as lead having attached to a flat side thereof a strap member having one or more loops formed therein. Said one or more loops being adapted to fit therethrough a person's fingers so as to provide x-ray radiation shielding to a person's hands while allowing the person to utilize his fingers in an unfettered manner to hold an object to be x-rayed. While holding the object to be x-rayed, the person's hands are positioned such that the radiation shield covers the person's hands from exposure to the x-ray apparatus during the taking of an x-ray picture.

9 Claims, 1 Drawing Sheet

X-RAY HAND SHIELD

BACKGROUND OF THE INVENTION

1. Field of the Invention

This invention pertains in general to the field of radiation protection apparatus and in particular to shields for protection of hands and wrists from x-ray radiation.

2. Description of the Prior Art

It is well known that radiation from x-rays during the taking of x-ray pictures for medical purposes is dangerous and can cause cancer in a person if that person receives an excessive dosage of x-ray radiation. It is also well known that it is the total accumulation of radiation received from x-rays that is of concern rather than the radiation received at any one particular time.

During the taking of x-rays of a person, it is usually possible for a medical assistant to protect himself from the radiation by moving away from the field of radiation and positioning himself behind a body shield made from a material which x-rays cannot penetrate, such as lead. The taking of x-rays of animals who are not sedated does not, however, allow a medical assistant to move away from the field of the x-rays and behind an x-ray barrier. The obvious reason being, of course, that animals will not necessarily stay in the position desired for the taking of particular x-ray views. During such occasions, it is necessary for the medical assistant to physically hold the animal in position during the taking of the x-ray picture. In such situations, to protect themselves from radiation, the medical assistants usually wear lead-lined gloves or rather mittens which prevent the x-rays from penetrating into the hand and wrist areas of the medical assistant. While being an effective barrier for the protection of x-rays, the lead mittens are relatively cumbersome and does not present the medical assistant with a feel for the object which he is holding. This lack of feel has, on occasion, caused the breaking of bones of relatively small animals when trying to hold them during the taking of x-rays.

Accordingly, an object of the present invention is to provide x-ray protection for the hands and wrists of medical technicians while holding an object to be x-rayed and yet allow the medical assistant a high degree of feel for holding the object.

Another object of the present invention is to provide x-ray shielding apparatus for a person's hands and wrists while holding an object during the taking of x-ray pictures, which apparatus is relatively lightweight but yet sufficiently protective against x-ray radiation.

Another object of the present invention is to provide x-ray shielding apparatus for a person's hands and wrists while holding an object during the taking of an x-ray, which shielding apparatus can be put on and taken off very quickly.

The above-stated objects as well as other objects which, although not specifically stated, but are intended to be included within the scope of the present invention, are accomplished by the present invention and will become apparent from the hereinafter set forth Detailed Description of the Invention, Drawings, and the Claims appended herewith.

SUMMARY OF THE INVENTION

The present invention accomplishes the above-stated objectives as well as others, as may be determined by a fair reading and interpretation of the entire specification herein, including the drawings and claims appended hereto, which comprises shields which may be placed over the hands and wrists of a person, which shields contain a layer of lead and thereby prevent the penetration of x-rays and which shields allow for the connection of the underside thereof to a person's fingers.

The x-ray protection shield of the present invention comprises layers of flexible lead as is well known in the industry, sandwiched between and appropriate cloth inner and outer covering. The sandwiched construction of the shields is sewn around the peripheral edge to maintain the relative position of the sandwiched components. The underside of the shield is provided with a plurality of linearly arranged loops for the fitting of a person's fingers therethrough. The wrist portion of the shield is provided with a strap having a velcro, or the like, closure attached thereto for securing of the same around the wrist of a person. When placed on the hands of a medical assistant, the lead shielding portion is placed over the top side of the hands with the person's fingers through the loops which allows the fingers to grasp the object to be x-rayed and position the object as desired for the taking of an x-ray picture. Thus, the present invention provides shielding against x-rays for person's wrists and hands and yet allows the person to use his hands directly to grasp an object.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
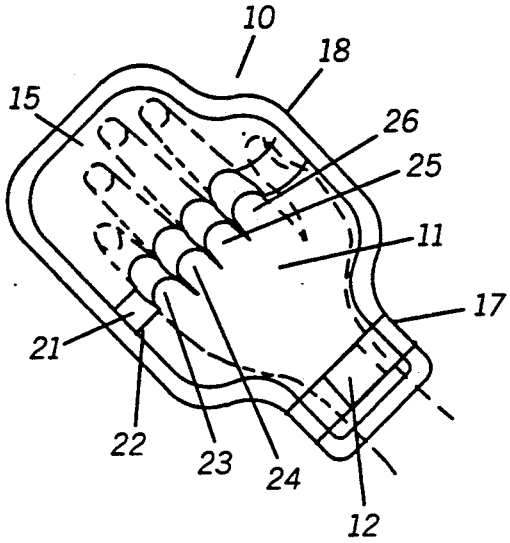
FIG. 1 is an undersided view of the radiation shield provided by the present invention showing the fit up of a person's hands and wrists thereto.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

Figure 2:
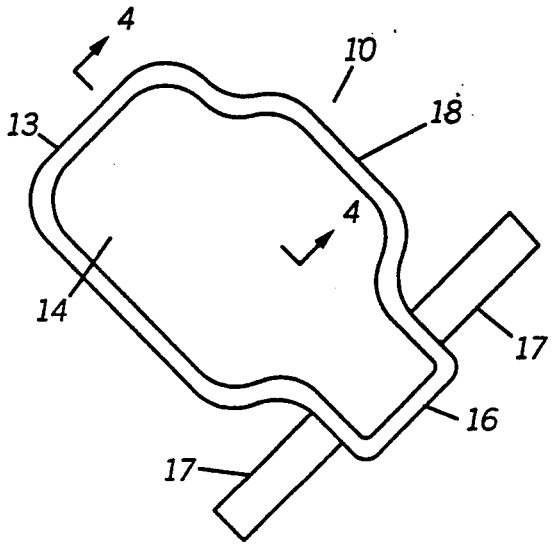
FIG. 2 is a view of the top side of the radiation shield provided by the present invention illustrating the protection provided to a person's hands and wrists.

Referring now to FIGS. 1 and 2 of the drawings, there is shown therein the overall configuration of the inventive radiation shield 10 as it is adapted to fit to the hand 11 and wrist 12 of a person. FIG. 1 shows the underside of the inventive radiation shield 10 in relation to the fit to a person's hand 11; while FIG. 2 shows the top view of the radiation shield 10.

The inventive radiation shield 10 is seen to have a substantially rectangularly shaped flat portion 13 having a top 14 and bottom 15. The inventive radiation shield 10 also includes a thumb portion 18, and a wrist portion 16, and an attached strap member 17. Thumb portion 18 is integrally connected to and extends outward from flat portion 13 so as to effectively cover a person's thumb when extended away from the other fingers as shown in FIG. 1 of the drawings. The extended thumb portion 18 provides the user with a high degree of flexibility and of shielding of the thumb.

Wrist portion 16 is integrally connected to rectangular portion 13, both of which include a layer of x-ray radiation shielding which will be further explained hereinafter with regard to FIGS. 2 and 5 of the drawings. Strap member 17 is attached to and extends laterally from wrist portion 16. Strap number 17 includes a hook and loop attaching apparatus enabling rapid attachment and release operations. The use of a hook and loop attachment apparatus further allows for convenient adjustability depending upon the size of the person's wrist utilizing the inventive radiation shield 10.

Finger attachment means 21 is attached to the underside 15 of radiation shield 10. Finger attachment means 21 comprises a strip of flexible material or webbing 22 positioned transverse to the longitudinal axis of rectangularly shaped flat portion 13 of the inventive shield 10. Webbed member 22 is fastened, such as by stitching, in the longitudinal direction with spaces between the rows of stitches. Between each row of stitches, the webbed member 22 is formed into a loop configuration resulting in an array of side-by-side openings 23, 24, 25, and 26, relative to the underside surface 15 of the inventive shield 10. Openings 23 through 26 allow for the fitting therethrough of a person's index finger through his pinky or little finger. As further shown in FIG. 1 of the drawings, webbed member 22 and the openings 23 through 26 provided therein fit between a person's second and third finger joints. It is to be noted that the number of openings provided by webbed member 22 is not restricted to four openings. Any number of openings one through four may be used.

In the embodiment shown in FIGS. 1 and 2 of the drawings, no provision is made for the attachment of a person's thumb to the rectangularly shaped portion of the inventive radiation shield 10. Thus, in the embodiment shown in FIG. 1 of the drawings, the movement of a person's thumb relative to his fingers is unrestricted by the radiation shield 10. The extending thumb portion 18 provides for radiation protection of the thumb while allowing relatively unrestricted motion of the user's thumb.

Figure 3:
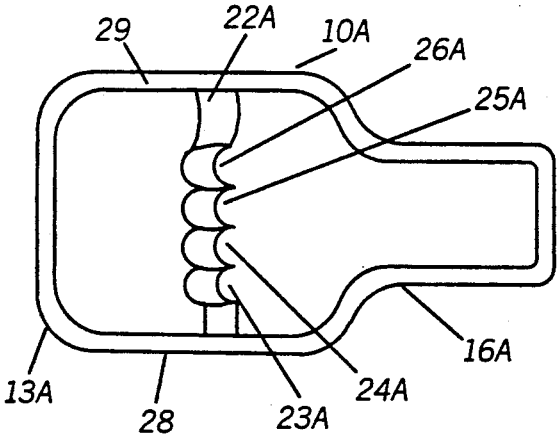
FIG. 3 is a plan view of another embodiment of the inventive radiation shield.

FIG. 3 illustrates an underside planar view of another embodiment of the inventive shield 10A. In the embodiment of FIG. 3, webbing member 22A includes the finger loops 23A through 26A as in the previous embodiment. No extending thumb portion of the flat portion 13A is provided in this embodiment. If desired, finger loops 23A through 26A may be slightly offset relative to side edges 28 and 29 such that finger loop 23A is closer to edge 28 than finger loop 26A is to that of edge 29. This offset may, therefore, provide for positive protection of a person's thumb from damaging x-ray radiation. Note, however, that the invention 10 also contemplates no offset whatsoever.

Figure 4:
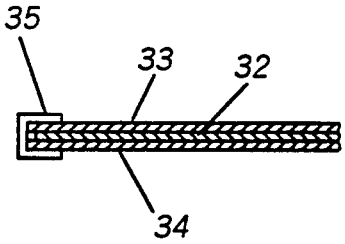
FIG. 4 is a cross-sectional view taking along the lines 4—4 of FIG. 2.

While FIG. 4 illustrates a cross section through the embodiment of FIGS. 1 and 2, it applies equally to a cross section of the embodiment of FIG. 3. A layer or layers of flexible shielding material 32 such as lead or a composite thereof is positioned between an upper cloth layer 34 and a lower cloth layer 34. Layers 32, 33, and 34 may be attached to each other by such means as stitching around the peripheral edge of rectangular portion 13 or 13A and wrist portion 16 or 16A. In the alternative, layers 32, 33, and 34 may be secured to each other by the use of edge welting 35 such that the stitching occurs through the welting 35 as well as layers 32, 33 and 34, completely around the periphery of the inventive radiation shield 10 or 10A. The thickness of shielding layer 32 may be a minimum of one-half a millimeter so as to exceed presently-established guidelines for protection against x-ray radiation.

Figure 5:
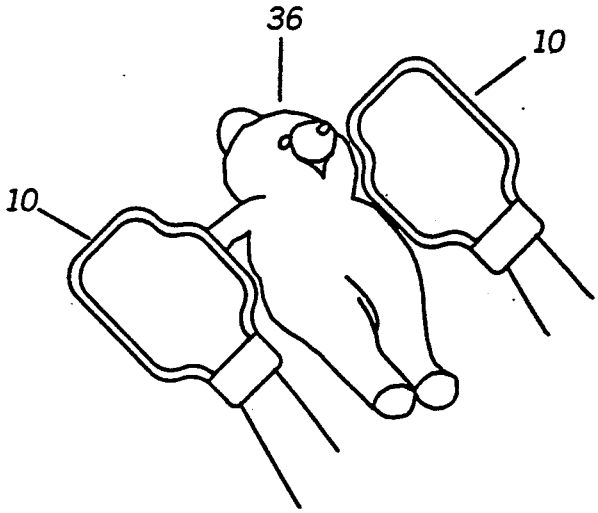
FIG. 5 illustrates the use of the inventive radiation shields when holding a small animal in place during the taking of x-ray pictures.

FIG. 5 illustrates the use of the inventive shielding 10 when being used to hold a small animal in a position on a table ready to be x-rayed. In FIGS. 1 and 5 it is seen how the inventive shielding 10 completely protects the hands and wrist portions of a person while holding the animal 36 to be x-rayed.

There are other variations that the invention may include in addition to those described above. For example, the wrist portion 16 may be extended to any desired length to cover a portion or all of a person's arm. Or, the size of the flat portion 13 may be somewhat larger. Or, individual fingers may be provided in the flat portion 13.

In accordance with the above, it is seen that an x-ray radiation shield is provided by the present invention which protects the hands and wrists of a person while that person is holding an animal to be x-rayed. Furthermore, in accordance with the above, it is readily seen that the degree of control in holding an animal 36 by a person is accomplished by the use of a person's fingers and hands without the bulkiness normally associated with x-ray radiation shielding.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. Radiation shielding apparatus adapted to shield a person's hands and wrists from radiation during the taking of x-ray pictures of an object while being held by the person having the x-ray shields attached to his hands and wrists, comprising a first flat portion covering a backside of the person's hand and a second flat portion covering a backside of the person's wrist, said first flat portion having finger means attached thereto for allowing attachment of a person's fingers to said first flat portion; and whereby an underside of the person's hand is free of any covering, other than said finger attaching means, allowing said person to grip an object with a bare hand while said first flat portion shieldingly covers the backside of said person's hand.

2. The apparatus of claim 1, including means for allowing attachment of said second flat portion to a person's wrists.

3. The apparatus of claim 2, wherein said means for attaching said second flat portion to a person's wrist comprises a strap member extending transversely from said second flat portion.

4. The apparatus of claim 1, including a third flat portion integrally attached to said first flat portion and extending outward therefrom, said third flat portion being covering the person's thumb.

5. The apparatus of claim 1, wherein said means to attach said first flat portion to a person's hands comprises one or more loops attached to an underside side of said first flat portion, said one or more loops being fitting therein one or more of a person's fingers.

6. The apparatus of claim 5, wherein said one or more loops comprises a flexible elongated member attached transversely to said underside side of said first flat portion and being attached thereto by spaced parallel attaching means so as form a plurality of spaced parallel loops with openings therethrough extending in a longitudinal direction of said first flat portion.

7. The apparatus of claim 6, wherein said one or more loops comprises four loops for fitting therethrough the person's index to pinky fingers on each hand.

8. The apparatus of claim 5, wherein said one or more loops are attached to said first flat portion offset to one side edge thereof such that the distance between a first edge and the loop adjacent thereto is larger than the distance between a second edge and the loop adjacent thereto for covering a person's thumb by said first flat portion.

9. The apparatus of claim 1, wherein a cross-sectional configuration of said shielding means comprises one or more layers made from radiation shielding material and one or more other layers to cover one or more sides of said one or more layers of radiation shielding material.

* * * * *